US005167530A

United States Patent [19]

Wallgren et al.

[11] Patent Number: 5,167,530

[45] Date of Patent: Dec. 1, 1992

[54] JACK CLUSTER WITH OFFSET MOUNTING POSTS

[75] Inventors: Robert L. Wallgren, Jersey City; Julio F. Rodrigues, Somerville, both of N.J.

[73] Assignee: Thomas & Betts Corporation, Bridgewater, N.J.

[21] Appl. No.: 820,718

[22] Filed: Jan. 14, 1992

[51] Int. Cl.[5] ..... H01R 17/18

[52] U.S. Cl. ..... 439/540

[58] Field of Search ..... 439/49–54, 439/532, 540, 638, 676, 709, 719

[56] References Cited

U.S. PATENT DOCUMENTS

| | | | |
|---|---|---|---|
| D. 317,297 | 6/1991 | Reed | D13/147 |
| 4,085,992 | 4/1978 | Ayer | 439/357 |
| 4,131,330 | 12/1978 | Stupay | 439/540 |
| 4,220,391 | 9/1980 | Krolak | 439/540 |
| 5,055,067 | 10/1991 | Field | 439/540 |

*Primary Examiner*—Neil Abrams

*Attorney, Agent, or Firm*—Robert M. Rodrick; Salvatore J. Abbruzzese

[57] ABSTRACT

A patch panel assembly includes a patch panel to which plural elongate jack clusters are mounted. The jack clusters are supported by the panel within openings therein. Each jack cluster has a front face adjacent a front surface of the panel and an opposed rear face adjacent a rear surface of the panel. Each jack cluster includes openings therein for receipt of plug type connectors from the front face thereof. In addition, each jack cluster includes a pair of mounting elements extending from the rear face thereof at opposed ends thereof. The pair of mounting elements are mutually transversely offset with respect to one another. The mounting elements support an elongate mass termination connector at an angularly offset relation with respect to the jack cluster.

11 Claims, 3 Drawing Sheets

JACK CLUSTER WITH OFFSET MOUNTING POSTS

FIELD OF THE INVENTION:

The present invention relates generally to electrical connectors supported on a mounting panel and more particularly relates to jack clusters supported by a patch panel permitting patching along one surface thereof and connection to a multi-conductor cable on the other.

BACKGROUND OF THE INVENTION

In data and communications networks the proper management of wiring running from a main location, such as a central processing unit for computers or the central office in the case of telecommunications, is essential for the proper operation of the system.

Proper wire management allows for distribution of information from the main source to many individual stations. Proper wire management must also permit flexibility, that is frequent changes in location of the terminals or telephones connected thereto.

The art has seen the use of patch panels to accommodate these changes. Patch panels typically include a flat metallic panel which accommodates a plurality of voice/data jacks which permit repeated connection of voice/data plugs. Changes are easily accommodated along one face of the patch panel by permitting the insertion and removal of different plugs into different jacks. Along the rear surface of the patch panel, multiconductor cables are terminated thereto. These cables bring the voice or data signal from the main station and are terminated to plural ones of the jacks supported by the patch panel.

The patch panel itself supports many jacks thereon. These jacks are typically clustered in sets of four or more and are arranged in spaced rows and columns along the patch panel. The total number of jacks on a given patch panel may vary, however some patch panels may include upwards of 100 individual jacks thereon. Each jack cluster typically connects to a 50-conductor cable which is itself terminated by a connector. It can be seen that in some patch panels as many as 25 cables may need to be terminated to the rear of the patch panel. As the jack clusters are arranged in side-by-side relationship, it is difficult to terminate adjacent clusters with its associated cable as the cable extending from one jack cluster may interfere with the connection area for the adjacent cluster.

It is therefore desirable to provide a patch panel assembly which will permit easy termination of plural cables to the rear of a patch panel where the termination to one jack cluster does not interfere with the termination to an adjacent jack cluster.

SUMMARY OF THE INVENTION

It is an object of the present invention to provide a jack cluster electrical termination housing which permits the patching of plug type connectors therein.

It is a further object of the present invention to provide a jack cluster electrical termination housing which is securable within an opening of a patch panel and which includes a pair of mounting elements permitting the mounting of a mass termination connection thereto at an angular orientation with respect thereto.

In the efficient attainment of these and other objects the present invention provides a jack cluster electrical termination housing including an elongate generally rectangular planar connector body having a front face, an opposed rear face and plural spaced receptacle openings therealong for receipt of a plug type connector in patching fashion. The connector body further includes a pair of mounting elements which permit the securing of an elongate mass termination connection thereto, the mounting elements extend from the rear face of the connector body at diagonally opposite corners thereof so that the mass termination connection is mounted in an angularly offset position with respect to the connector body.

As shown by way of preferred embodiment herein, the planar connector body is employed in a patch panel assembly which further includes an elongate patch panel having a front surface, a rear surface and plural panel openings therethrough. The plural rectangular connector bodies are supported within the panel openings. Each connector permits the termination of a mass termination connector at the rear face of the patch panel, the mass termination connector being mounted at an angular orientation with respect to the connector body to permit the cable extending from the mass termination connector to pass between adjacent connector bodies.

DETAILED DESCRIPTION OF THE PREFERRED EMBODIMENTS

Figure 1:
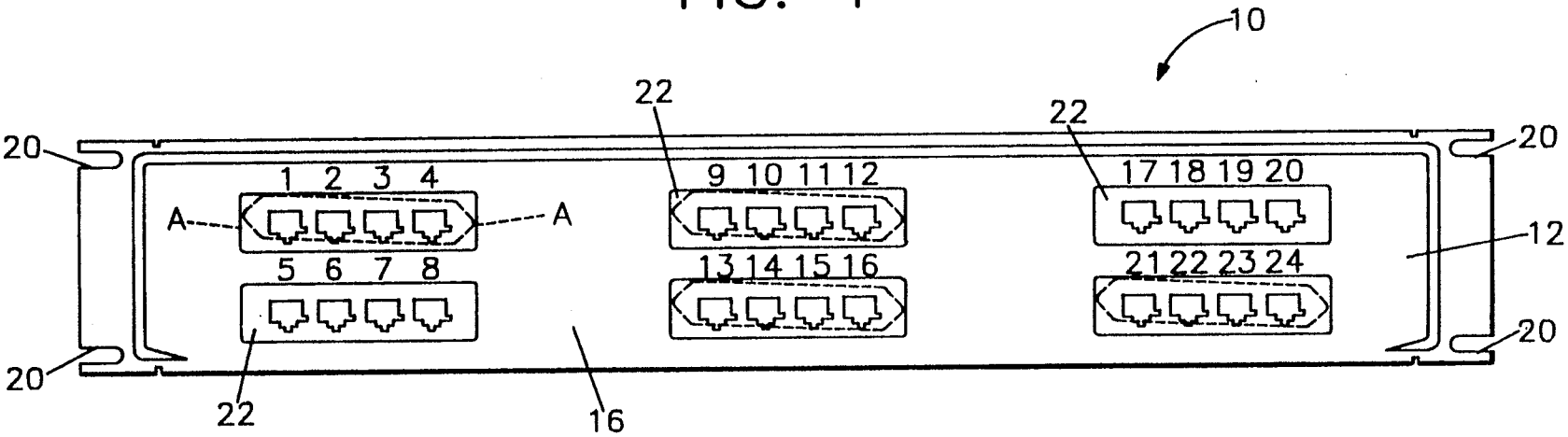
FIG. 1 shows in front plan view a patch panel assembly of the present invention.
Figure 2:
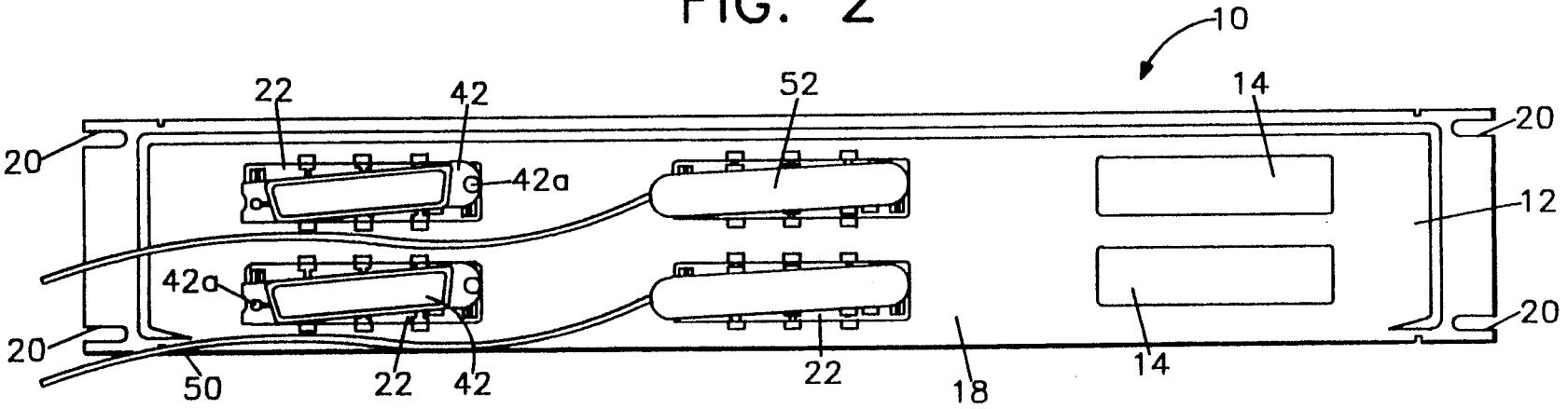
FIG. 2 shows in rear plan view the patch panel assembly of FIG. 1 with plural cable connectors mounted thereto.

Referring to FIGS. 1 and 2, patch panel assembly 10 of the present invention is shown. The patch panel assembly 10 includes a patch panel 12 which is generally a rectangular planar member having a plurality of openings 14 extending between a front face 16 and a rear face 18. Patch panel 12 is generally of conventional construction and is typically formed of metal and includes openings 14 arranged in plural aligned columns and rows. The shape and number of openings 14 as well as the size of patch panel 12 may vary as is necessitated by particular wiring requirements. Corner flanges 20 of patch panel 12 permit the panel to be mounted within a wiring closet or other location during use.

Figure 3:
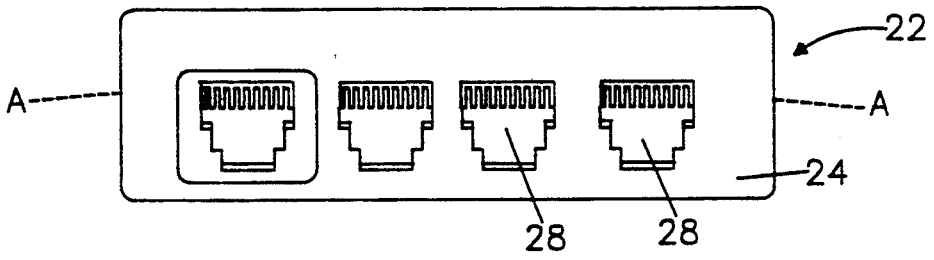
FIGS. 3 and 4 show respectively front and rear plan views of the jack cluster termination housing of the present invention.
Figure 4:
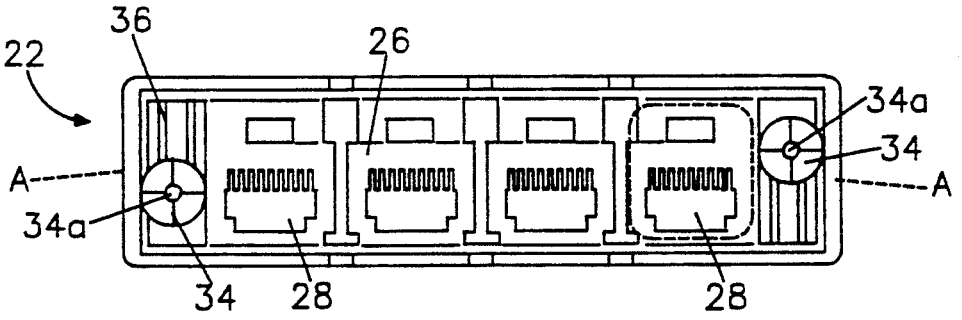
Figure 5:
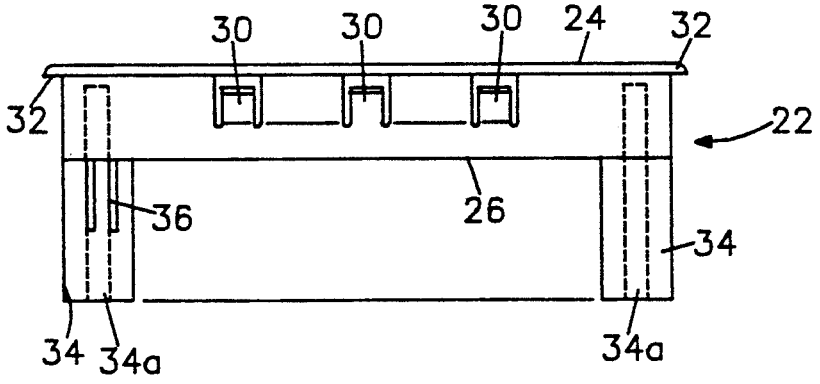
FIG. 5 is a side elevational showing of the jack cluster electrical termination housing of FIGS. 3 and 4.

Positioned within each opening 14 of panel 12 is a jack cluster electrical termination housing 22. Termination housing 22 shown additionally and in more detail in FIGS. 3–5, is an elongate generally rectangular member typically formed of molded plastic having a front surface 24 and opposed rear surface 26 and a plurality of apertures 28 extending therebetween in spaced longitudinal fashion. Apertures 28 are conventional jack- type apertures which accept modular plugs which are formed in industry standard configuration.

In the present illustrated embodiment housing 22 includes four longitudinally spaced apertures 28, however depending upon the wiring pattern, greater or fewer apertures may be included on each housing 22. Housing 22 is configured to receive plug-type elements (not shown) within apertures 28 through the front face 24 thereof. These plug-type elements may be selectively removed and reinserted into different ones of the apertures 28 to provide for patching ability. As is shown in FIG. 1 the individual apertures or ports may be numbered to uniquely identify a particular patching scheme.

As shown in FIG. 5, housing 22 includes plural latches 30 extending along the upper and lower longitudinal edges thereof so that housing 22 may be snapped into patch panel 12 through opening 14. The housing 22 is inserted through opening 14 from the front face 16 thereof whereupon latches 30 engage the rear face 18. A flange 32 about housing 22, works in cooperation with latches 30 to secure housing 22 to patch panel 12.

Referring now to FIGS. 4 and 5, housing 22 of the present invention includes a pair of mounting legs 34 which extend upwardly from the rear surface 26 thereof. Mounting legs 34 are generally cylindrical in shape having a centrally threaded aperture 34*a* therethrough for accommodating a mounting screw as will be described in further detail hereinbelow.

As particularly shown in FIG. 4 mounting legs 34 extend adjacent diagonally opposed corners of rectangular housing 22. Thus, mounting legs 34 are transversely offset with respect to one another and thus skewed with respect to a central horizontal axis A of housing 22. Housing 22 further includes stiffening ribs 36 which help support mounting legs 34 preventing the breakage thereof.

Figure 7:
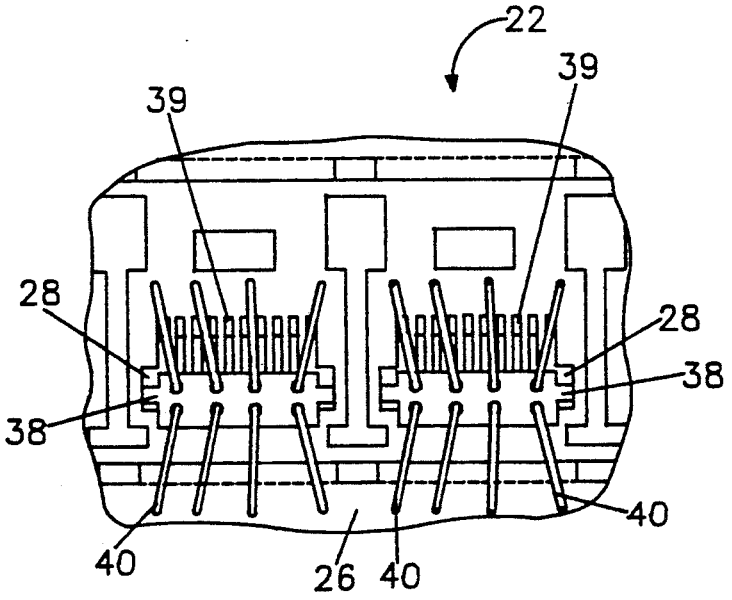
FIG. 7 is a cross-sectional showing of the patch panel assembly of FIG. 6 taken through the lines VII–VII thereof.

Referring now to FIG. 7 a connector insert 38 is shown positioned within each aperture 28 of housing 22. Insert 38 supports plural electrical contacts 39 which are positioned adjacent front face 24 to permit electrical interconnection to the plug connector. Each insert 38 also includes a plurality of insulated conductors 40, one associated with each contact 39, which establish electrical connection between contacts 39 and a mass termination electrical connector as will be described hereinbelow.

In the present illustrated embodiment each aperture 28 supports an insert 38 having eight contacts 39 and eight associated conductors 40. However, as is common in the industry, inserts having four or six contacts and conductors may also be employed.

Figure 6:
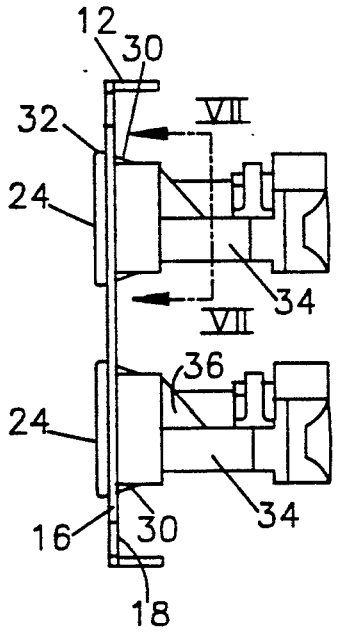
FIG. 6 is a side elevational showing of the patch panel assembly of FIG. 2 including mass termination connectors mounted thereto.

Referring now to FIGS. 2 and 6 the features and benefits of the present invention may now be described. In order to bring data and communication signals to housing 22, a mass termination connector 42 may be electrically and mechanically secured to housing 22 adjacent rear face 18 of patch panel 12. Mass termination connector 42 is of conventional construction having a plurality of electrical contacts therein (not shown). Typically, mass termination connector 42 supports fifty electrical contacts which are individually electrically connected to insulated conductors 40 extending from housing 22. Mechanical and electrical connection of mass termination connector 42 to housing 22 is typically accomplished by factory automation, however, hand assembly may also be employed. The mechanical mounting of mass termination connection 42 to housing 22 is accomplished by screws or other fastening members (not shown) which are inserted through openings 42*a* on either side of mass termination connection 42 and then are threadingly fastened to mounting legs 34 through threaded opening 34*a*.

It can be seen that due to the particular location of mounting legs 34, elongate mass termination connector 42 will be secured in an angular offset relation with respect to central horizontal axis A (FIG. 1) of elongate housing 22. As shown in FIG. 2, mass termination connectors 42 are positioned diagonally across housings 22.

Also shown in FIG. 2 are a pair of electrical cables 50 which are terminated at their ends thereof by mating electrical connectors 52. Mating electrical connectors 52 are conventional in construction and electrically and mechanically attach to mass termination connectors 42. Since each mass termination connector 42 is mounted on a diagonal with respect to housing 22, the cables 50 extending from mating connector 52 terminated thereto, will extend between two vertically adjacent housings 22. Thus, when the user is to mount plural mating connectors 52 having associated cables 50 to the rear of a patch panel assembly 10, the angular orientation of mass termination connectors 42 will permit adjacent connections to be made easily without cable 50 of one connection interfering with the connection of an adjacent connector by overlapping it. Cable 50 conveniently extends between vertically adjacent connection locations.

Having described the preferred embodiments herein it should be appreciated that variations thereof may be made thereto without departing from the contemplated scope of the invention. As such, the preferred embodiments are illustrative rather than limiting. The true scope of the invention is set forth in the claims appended hereto.

I claim:

1. A jack cluster electrical termination housing comprising:

an elongate generally rectangular planar connector body having a front face, an opposed rear face and plural longitudinally spaced receptacle openings therethrough accessible from the front face thereof; and a pair of mounting elements for securing ends of an elongated mass termination cable connector thereto, said mounting elements extending from said rear face of said connector body, one element of said pair extending from diagonally opposite corners of said rectangular planar body.

2. A jack cluster electrical termination housing of claim 1 further comprising:

securement elements for securing said connector body within an opening in an electrical patch panel.

3. A jack cluster electrical termination housing of claim 1 wherein said connector body receptacle openings are formed into discrete jack-type configurations.

4. A jack cluster electrical termination housing of claim 1 wherein said connector body is formed from molded plastic.

5. A jack cluster electrical termination housing of claim 4 wherein said mounting elements are molded integrally with said connector body.

6. A patch panel assembly comprising:

an elongate patch panel having a front surface, an opposite rear surface and plural elongate panel openings therethrough spaced in longitudinal succession;

plural elongate jack clusters supported by said panel within said openings thereof, said jack clusters having a front face adjacent said front surface of said panel, an opposed rear face adjacent said rear surface of said panel and plural longitudinally spaced jack openings being accessible from the front face thereof, each said jack cluster further including a pair of mounting elements one element of each said pair extending from said rear face at opposed ends of said jack cluster, said pair of mounting elements being mutually transversely offset with respect to a longitudinally central axis of said elongate jack cluster; and plural elongate mass termination connectors being secured by said mounting elements to said jack clusters, said elongate mass termination connectors being longitudinally skewed with respect to said elongate jack cluster.

7. An assembly of claim 6 wherein said elongate jack cluster is generally rectangularly shaped and wherein said mounting elements extend from diagonally opposed corners thereof.

8. An assembly of claim 7 wherein said elongate jack cluster includes locking elements for securing said connector to said panel.

9. An assembly of claim 8 wherein said panel includes said plural openings arranged in aligned rows and columns.

10. An assembly of claim 9 wherein each said mass termination connector connects to an electrical cable.

11. An assembly of claim 10 wherein said one of said cables extends between a pair of adjacent panel openings.

* * * * *